United States Patent [19]

Michel

[11] Patent Number: 4,644,994

[45] Date of Patent: Feb. 24, 1987

[54] APPARATUS FOR HARDENING CORES AND/OR MOLDS MADE OF SAND WITH THE ADDITION OF HARDENABLE BINDING AGENTS

[76] Inventor: Horst W. Michel, Industriestr. 7, 7707 Engen-Hegau, Fed. Rep. of Germany

[21] Appl. No.: 743,829

[22] Filed: Jun. 12, 1985

[30] Foreign Application Priority Data

Jun. 19, 1984 [DE] Fed. Rep. of Germany ..... 3422742

[51] Int. Cl.[4] ..... B22C 9/12

[52] U.S. Cl. ..... 164/12; 164/154

[58] Field of Search ..... 164/16, 12, 154

[56] References Cited

U.S. PATENT DOCUMENTS

| | | | |
|---|---|---|---|
| 3,590,902 | 7/1971 | Walker et al. | 164/16 |
| 4,105,725 | 8/1978 | Ross | 164/16 |
| 4,359,082 | 11/1982 | Michel | 164/16 |
| 4,483,384 | 11/1984 | Michel | 164/16 |

FOREIGN PATENT DOCUMENTS

| | | | |
|---|---|---|---|
| 2162137 | 6/1973 | Fed. Rep. of Germany | 164/16 |
| 2413537 | 10/1975 | Fed. Rep. of Germany | 164/16 |

*Primary Examiner*—Nicholas P. Godici

*Assistant Examiner*—Samuel M. Heinrich

*Attorney, Agent, or Firm*—Price, Heneveld, Cooper, Dewitt & Litton

[57] ABSTRACT

An apparatus for hardening cores and/or molds made of sand with the addition of hardenable binding agents, which are used for casting molded bodies from flowable substances, is described, whereby an amount, predetermined by metering devices controlled via control valves, of the substance which causes the binding agent to harden is introduced into the core or mold by aid of compressed air the rate of flow of which is regulatable by a regulating valve, whereby this substance is mixed with this compressed air, and the regulating valve is automatically controlled according to a predetermined schedule. The apparatus can be carried out with considerably fewer components and the necessary control means can in particular be designed much more simply if, according to one embodiment, the regulating valve is controlled by means of a proportional pressure regulating valve which is operated by an external control means which also controls the other control valves. As an alternative to this, the regulating valve can be controlled, according to a second embodiment, via a preadjustable pressure regulating valve and a directional valve which is controlled electrically or pneumatically.

1 Claim, 2 Drawing Figures

APPARATUS FOR HARDENING CORES AND/OR MOLDS MADE OF SAND WITH THE ADDITION OF HARDENABLE BINDING AGENTS

The present invention relates to an apparatus for hardening cores and/or molds made of sand with the addition of hardenable binding agents, which are used for casting molded bodies from flowable substances, whereby an amount, predetermined by metering devices controlled by control valves,of the substance which causes the binding agent to harden is introduced into the core or mold by aid of compressed air the rate of flow of which is regulatable by a regulating valve, whereby this substance is mixed with this compressed air, and the regulating valve is automatically controlled according to a predetermined schedule.

German Offenlegungsschrift No. 28 33 305.3 describes an electropneumatic control means which makes it possible to produce a predetermined schedule for feeding compressed air in an apparatus, in which a conduit for a liquid catalyst leads to a mixing chamber, and a heating means and controlled valves are provided for controlling the entrance of the compressed air and the entrance of the catalyst into the mixing chamber in time with the operating sequences, the heating means preceding the mixing chamber and a further shut-off valve being provided between the mixing chamber and the core or mold.

The schedule for the operating sequence is divided up into a clock time and a quiescent time. At the beginning the compressed air fed in has a specific pressure value, for example 2 bar, which is controlled via a valve assembly and may go up to 6 bar, for example, in the course of the clock time. At the beginning of the operating sequence, catalyst gasified under the initial pressure of the compressed air is located in the mixing area, which is composed of the heating means and a mixing chamber. This catalyst is expelled by the addition of the compressed air and finally reaches a quantitative proportion of zero in the mixing chamber. The so-called hardening period lasts from the starting time until the time when the catalyst finally reaches the quantitative proportion of zero in the mixing chamber. This is then followed by a rinsing process. The rinsing is carried out with pure compressed air. At the end of the clock time the system is sealed off from the compressed air source so that the pressure of the compressed air can be completely relieved, finally arriving at a normal value corresponding to the external pressure. The clock time is then over and a quiescent time, which is as long as desired, begins.

In addition, the suction pump for the liquid catalyst has begun to operate at the beginning of the operating sequence and continues to operate until a point is reached which depends upon the amount of catalyst to be taken in.

The known apparatus works electropneumatically, which means that a number of mechanical components and in particular valves must be present. The valves, in particular, are subject to wear, however, and may thus become defective. Many screw connections and seals must also be present, which may begin to leak.

The invention is based on the problem of providing an apparatus which can function using considerably fewer components and in particular allows for a substantial simplification of the necessary control means. Furthermore, it should be possible to provide the entire circuitry in a control case, thereby allowing for the possibility of remote control.

This problem is solved according to an embodiment of the invention by having the regulating valve be controlled by means of a proportional pressure regulating valve which is operated by an external control means which also controls the other control valves.

An alternative to this which still allows for manual intervention and can also be produced much less expensively consists in having the regulating valve be controlled via a preadjustable pressure regulating valve and a directional valve controlled electrically or pneumatically.

A particular advantage of the inventive apparatus which is present in both embodiments consists in the fact that several metering cycles can be obtained during the operating sequence, i.e. the period during which the compressed air is running. This allows for the possibility of precisely adapting the metering to the size of the work piece. The amount metered can now be multiplied as often as desired, which can be done by simply adding a further valve capable of being controlled by the control means along with the others.

Proportional pressure regulating valves are known, of course. But it was never realized that the use of such a proportional pressure regulating valve can not only solve the problem posed but also allow for further considerable advantages to be achieved.

The term "flowable substance" refers to substances from which a molded body can be produced in a mold, it being unimportant whether the starting material for producing said body is a substance heated to form a melt or a slurry, etc., made by adding liquid to a powdery substance, or a substance fluidized in another manner.

The term "sand" refers to all substances whose consistency ranges from powdery to granular which are suitable for producing molds and/or cores and can be compacted by means of a hardenable binding agent.

BRIEF DESCRIPTION OF THE DRAWINGS

In FIG. 1 the connection to a compressed air source is referred to as 1, this source being under a pressure, for example, of 6 bar. At 2 one can see a water, oil and dirt trap which makes sure that the plant is subjected only to clean compressed air. The compressed air which enters arrives at regulating valve 3 which is controlled via the proportional pressure regulating valve 4. The compressed air goes from regulating valve 3, whose control means is schematically indicated at 3*a*, via a measuring instrument 5 and a safety check valve 6 to heating block 7 which is penetrated by labyrinth channels conducting the compressed air and is preferably made of aluminum. Heating resistors whose connections are indicated at 8 are cast into this heating block 7. 9 refers to a temperature measuring instrument, for example in the form of a resistance thermometer. Conduit 10 leads directly to the mold in the direction of the arrow.

Figure 1:
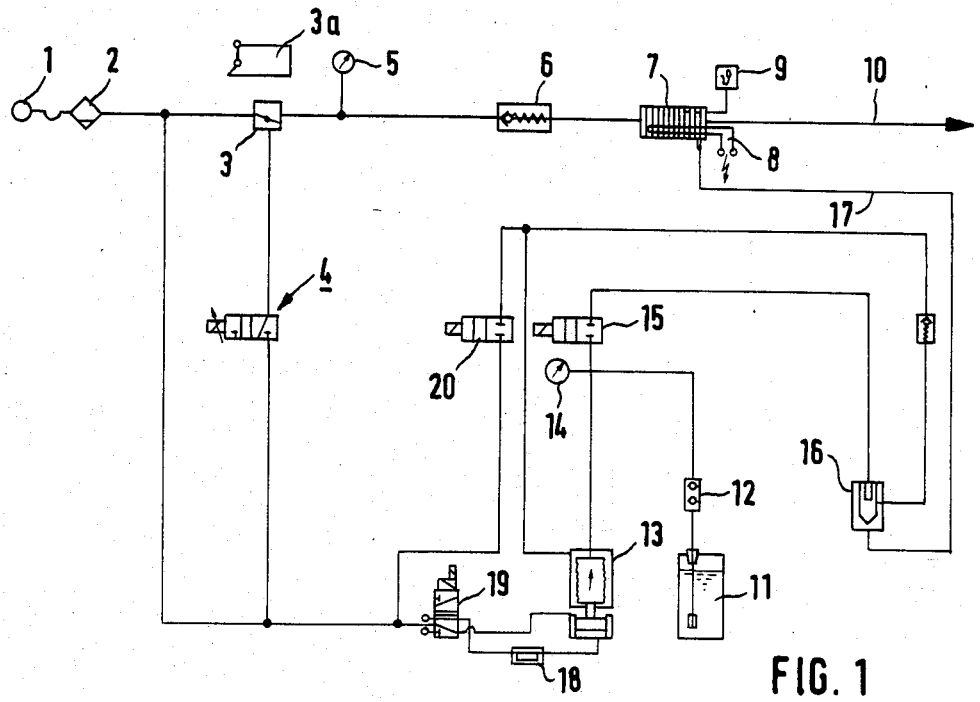
FIGS. 1 and 2 show the two alternative solutions according to the invention in the form of connection diagrams.

The substance which hardens the binding agent in the sand located in the mold, e.g. a catalyst, is taken from a supply vessel 11 via a check valve 12 by aid of a metering pump 13. 14 refers to a pressure measuring instrument for indicating the pressure of this substance.

The substance goes from metering pump 13 via a valve assembly 15 and a mixing chamber 16 and via conduit 17 into heating block 7 and is conveyed out of it via conduit 10 to the mold in the corresponding cycle.

The assembly consisting of choker valve 18 and operating valve 19 is used for the corresponding clock generation and the adjustment of the suction speed.

A directional valve is provided at 20 via which an air stream is conducted into mixing chamber 16. There the air stream atomizes the substance coming out of metering pump 13 and carries it via conduit 17 into heating block 7.

Figure 2:
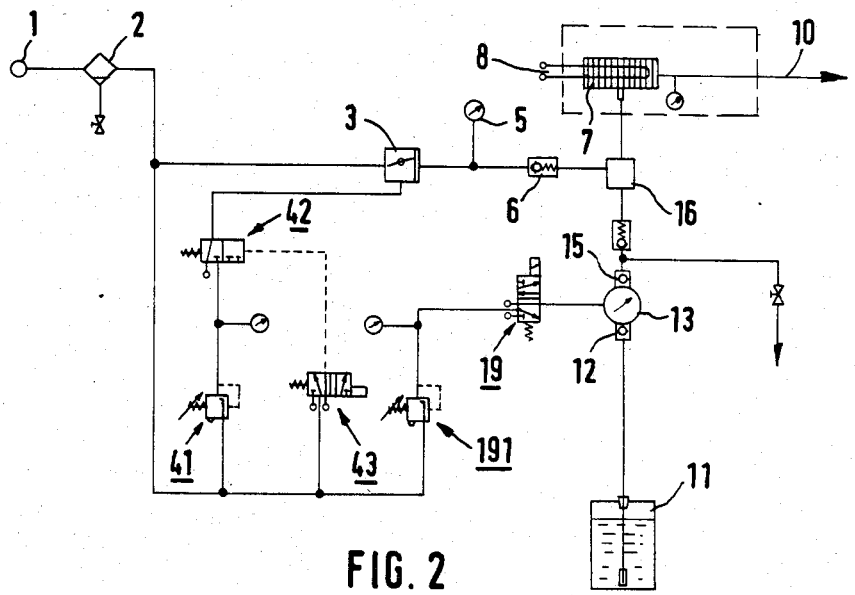

In FIG. 2, parts which are the same as those in FIG. 1 are referred to with the same reference numbers so that they do not need to be described in detail. Proportional pressure regulating valve 4 which is shown in FIG. 1 is replaced in the embodiment as in FIG. 2 by a pressure regulating valve 41 which can be preadjusted by hand and acts upon regulating valve 3 via a directional valve 42 which is controlled electrically or pneumatically. The control means for this directional valve 42 may be housed in this directional valve 42 itself if it is controllable with virtually no friction from depressurized up to the final value. In the normal case directional valve 42 is controlled by an electropneumatic directional valve 43 or directly by a pneumatic control means which is not shown but is known per se.

In this embodiment, further, operating valve 19 of metering pump 13 is influenced by a manually adjustable pressure regulator 191, thereby allowing for multiplication of the amount metered. Directional valve 20 of the embodiment as in FIG. 1 can be dispensed with because the compressed air conduit to heating block 7 is conducted directly via mixing chamber 16.

I claim:

1. An apparatus for hardening sand cores and molds by the addition thereto of a hardenable binding agent during each cycle of operation, a source of air unde pressure, said apparatus comprising: a conduit connected at one end to a source of air under pressure and discharging into the mold at the other end; a source of binding agent and a heating chamber for gasifying the binding agent, said binding agent source being connected to said heating chamber, said heat ing chamber being mounted in said conduit between said air source and said mold; means between said binding agent source and said heating chamber for injecting a measured quantity of the binding agent into said heating chamber; a flow control valve in said conduit between said air source and heating chamber; a single pressure regulating and reducing valve connected to said air source and to said flow control valve; the operation of said flow control valve being solely controlled by said pressure regulating and reducing valve; said flow control valve being normally closed and periodically operable to sequentially connect said heating chamber to said air source through said pressure regulating and reducing valve and then connect said heating chamber directly to aid air source whereby and throughout an initial period of air is passed at a substantially constant reduced pressure through said heating chamber for a period of time sufficient to introduce the entire change of binding agent therein to the mold and a subsequent purging charge of air is passed through said heating chamber and mold at a substantially constant pressure equal to the pressure of air from said air source.

* * * * *